United States Patent [19]

Hevoyan

[11] Patent Number: 4,705,924

[45] Date of Patent: Nov. 10, 1987

[54] WALL SWITCH EXTENSION OPERATOR

[76] Inventor: Varoujan H. Hevoyan, 6318 W. 77th St., Los Angeles, Calif. 90045

[21] Appl. No.: 873,347

[22] Filed: Jun. 12, 1986

[51] Int. Cl.[4] ..... H01H 3/04

[52] U.S. Cl. ..... 200/331

[58] Field of Search ..... 200/331

[56] References Cited

U.S. PATENT DOCUMENTS

| | | | |
|---|---|---|---|
| 2,493,581 | 1/1950 | Hood | 200/331 |
| 2,775,674 | 12/1956 | Mider | 200/331 |
| 3,004,128 | 10/1961 | Mikolajeski | 200/331 |
| 3,339,051 | 8/1967 | De Vall | 200/331 |
| 3,916,134 | 10/1975 | Hansen | 200/331 |

FOREIGN PATENT DOCUMENTS

| | | | |
|---|---|---|---|
| 930780 | 7/1973 | Canada | 200/331 |

OTHER PUBLICATIONS

McMaster-Carr Cat., (Copy Enclosed), "Light Switch Extension Handle".

*Primary Examiner*—Henry J. Recla
*Assistant Examiner*—Renee S. Luebke
*Attorney, Agent, or Firm*—William H. Maxwell

[57] ABSTRACT

A switch plate toggle operating device for installation onto the switch pulse without disturbing the same, and characterized by a guide permanently secured to the switch plate by existing fasteners, and by an operator removable from the guide and adapted to be replaced as required for push-pull operation of the toggle into "ON" and "OFF" positions, the operator being flexible so as to permit easy removal, automatic reassembly, and to provide for manual convenience without undue stress thereto.

4 Claims, 4 Drawing Figures

WALL SWITCH EXTENSION OPERATOR

BACKGROUND OF THE INVENTION

This invention relates to the operation of toggle-type wall switches, by persons who have restricted ability in their access thereto, it being a general object of this invention to permit children, wheelchair patients, and any others with limited arm extension to conveniently manipulate switch toggles otherwise out of their reach.

The position of wall switches is standardized for the convenience of persons with normal reach, but at a height which is inconvenient and in many instances impossible for operation by children or other persons of small stature, wheelchair patients or paraplegics and the like. Accordingly, it is an object of this invention to extend the accessability of the switch toggle to a lower level, by means of an attachment to the wall switch as herein described.

Switch toggle extensions of the prior art have been difficult to instal, and they have not been easily removable. That is, known devices of this type have been permanently installed by removing the switch plate, followed by a permanent re-assembly which is difficult and time consuming, as well as dangerous since removal of the plate exposes the switch body and its electrified wiring. More particularly, wall switches of the type under consideration are permanently installed and hard-wired into junction boxes flush with the wall surface and a permanent part of the building structure. Characteristically, there is the protective switch plate that encloses the box and which covers the hard-wiring with the switch toggle projecting therethrough for manual operation. A standardized switch of the type under consideration has at least one pair of screw fasteners that enter through the protective switch plate and into threaded bracket openings, for mounting the switch plate in a protective position over the junction box and covering the otherwise dangerous hard-wiring. It is an object of this invention to preserve the permanent switch and switch plate installation, and to instal the Wall Switch Extension Operator without disturbing and without removal of the switch plate. With the present invention, only the lowermost screw fastener is removed and replaced through the switch plate, to secure the guide means of the operator in its working position.

Heretofore, operators for toggle switches have been permanently installed and have not been removable and replaceable at the convenience of the user. For example, such operators have been permanently installed beneath the switch plate or a like body, which requires the time consuming and dangerous removal and replacement of the switch plate. Accordingly, it is an object of this invention to provide for removal and replacement of the operator means without disturbing the aforementioned guide means, in any way. With the present invention, the operator means is characterized by a flexible member with an aperture engageable over the switch toggle. Flexibility of said member enables its manipulation into and out of working position, aided by the angular "ON" (up) position of the toggle. The flexibility of the operator is enhanced further by a swivel connection beneath the guide means, whereby lateral manipulation is made possible and without damage to the guided portion thereof. The lower end of the operator means can be provided with a grip or like configuration.

SUMMARY OF THE INVENTION

The Wall Switch Extension Operator as it is disclosed herein is an assembly that is adapted to the switch plates of permanently installed toggle switches, all without disturbing the switch installation and its electrified wiring. That is, the permanency of the electrical installation is not affected and is in no way disturbed nor is it dangerously exposed. The present invention features a guide means that is adapted to the switch plate by the removal of a single existant screw and by its replacement through the guide means secured thereby. The present invention features the replaceble adaptability of its operator means by its flexibile manipulation into and out of working position through the guide means and over the toggle of the switch. And, the present invention features a swivel connection beneath the guide means, by which the operator means can be pulled and pushed at a substantial angle, for convenience and to avoid damaging stress thereto.

The foregoing and various other objects and features of this invention will be apparent and fully understood from the following detailed description of the typical preferred form and application thereof, throughout which description reference is made to the accompanying drawings.

THE DRAWINGS

Figure 3:
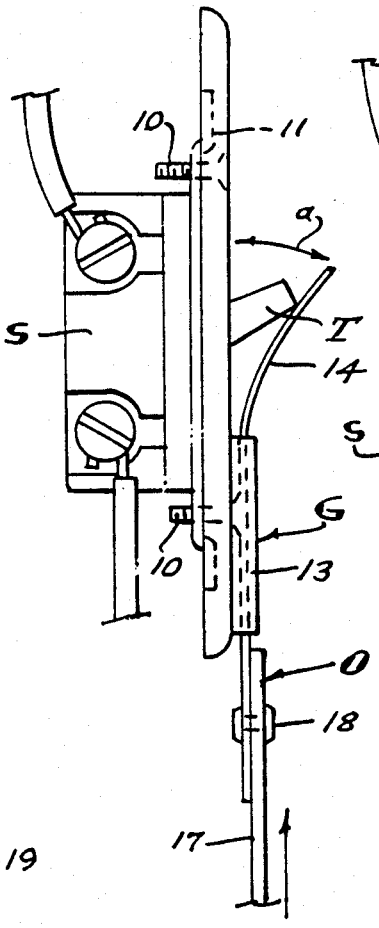
FIG. 3 is a side view of the switch plate and Wall Switch Extension Operator combination, taken as indicated by line 3—3 on FIG. 1.
Figure 4:
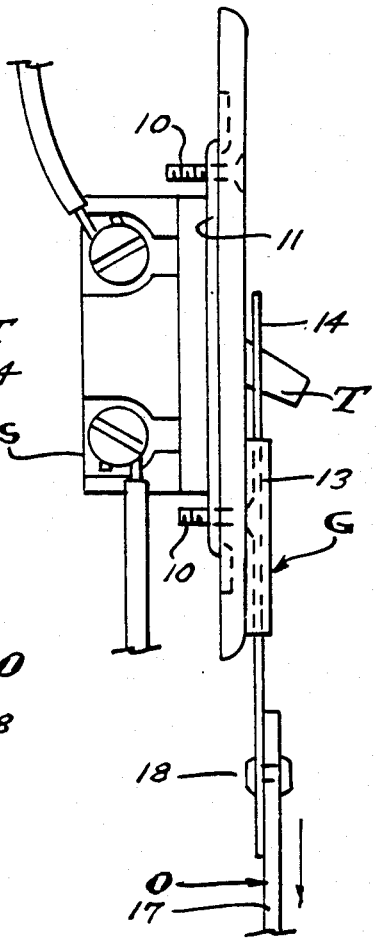

And FIG. 4 is a view similar to FIG. 3, illustrating the switch toggle in an alternate position; the toggle being in the "ON" condition in FIG. 3 and in the "OFF" condition in FIG. 4.

PREFERRED EMBODIMENT

Referring to the drawings, the Wall Switch Extension Operator is adpated to be installed upon a wall switch and combined therewith for shifting the switch toggle "ON" and "OFF". A feature of the invention is the adaptability of this operting device without disturbing the switch plate and therefore without dangerously exposing the electrical wiring that is involved. As shown, this operating device involves generally, guide means G for securement to the switch plate P, and operating means O for shifting the switch toggle T between the alternate "ON" and "OFF" positions. The guide means G can be permanently installed onto the switch plate P, and the operating means O is removable and replaceable at the will of the user. However, the said operating means O remains intact with the guide means unless deliberately removed.

The building wall and junction box are not shown, however it is to be understood that the switch S and switch plate P installation is permanent and is not disassembled in the practice of this invention. As shown, there is a pair of screw fasteners 10 that secure the switch plate to the wall by threaded engagement into the switch bracket 11 that is mounted to the junction box in the usual manner. For each toggle T the switch plate P has a vertically disposed opening that permits the toggle to swing between an upwardly angled "ON" position (see FIG. 3) and a downwardly angled "OFF" position (see FIG. 4). When in the "ON" position, the lower face of the toggle body is exposed with the indicia "ON" visible therethrough, the position shown in FIGS. 1 and 2; the upper face with the indicia "OFF" being visible when in the "OFF" position shown in FIG. 4. In practice, the angularly positioned faces of the toggle T are disposed at about 120° with respect to the plane of the switch plate P, at one side and at about 60° at the other side. That is, when in the "OFF" position the lower side face is at an acute downward angle of 60° to the switch plate, and when in the "ON" position the upperside face is an an acute upward angle of 60° to the switch plate. Significantly, when in the "ON" position the downward side face of the toggle is at an obtuse upward angle of 120°. The angles given vary with toggle configurations of different design, a usual toggle T throughout its radial movement being one half inch from the face of the switch plate P.

In accordance with this invention, I provide the guide means G for permanent installation onto the exterior of the guide plate P. The screw fasteners 10 are in vertical alignment with the toggle opening in the switch plate and the guide means G is centered over the lowermost of said screw fastener placements. The guide means G can vary in form and is preferably of C-shape cross section having oppositely inturned parallel rails 13 to embrace the operating means O next described. A feature of the guide means G is that its body is flat and relatively thin as it lies contiguous to the front face of the switch plate P. Accordingly, the operating means O is guided close to said front face of the switch plate, so as to engage with the root portion of the toggle as shown. Assembly to the switch plate is by removal of the lowermost screw fastener 10 and its replacement through a counter-sunk opening in the guide means body, and re-threading it into the switch bracket 11, as clearly shown in FIGS. 3 and 4.

The operating means O is an elongated member that depends vertically from the guide means G through which its upper portion slides. The guided upper portion of the operating means O is a flat member 14 with parallel edges 15 guided between the rails 13, so as to reciprocate freely in a vertical direction. The upper portion of the member 14 extends above the guide means G to overlie the toggle T in both its "ON" and "OFF" positions, and it has an aperture 16 therethrough to pass the toggle with some clearance. The lower portion of the member 14 extends below the guide means G to be manually engageable, so as to be pushed upwardly or pulled downwardly. Accordingly, the toggle T embraced within the aperture 16 is shifted to the alternate "ON" and "OFF" positions when pushed or pulled by the operating member 14.

Figure 1:
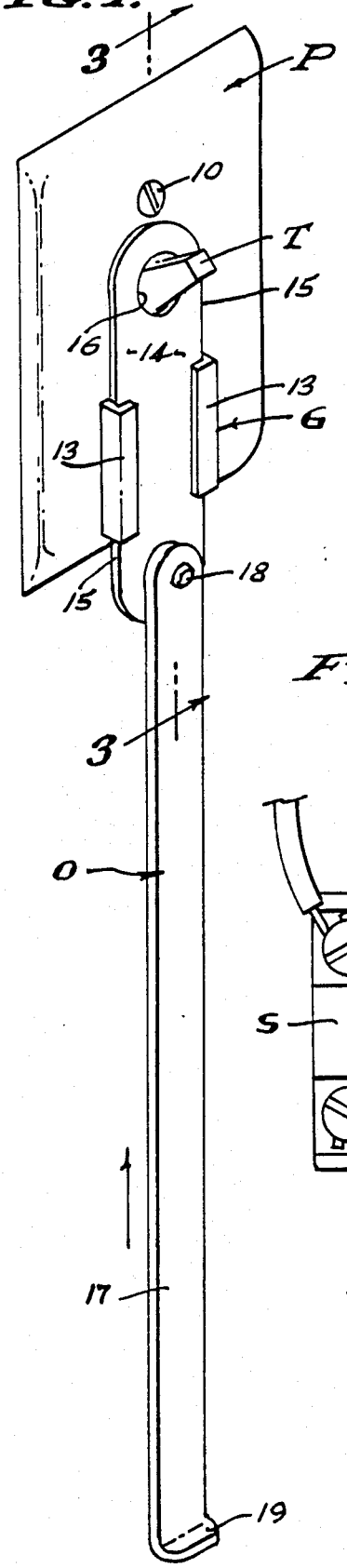
FIG. 1 is a perspective view showing a switch plate with the Wall Switch Extension Operator combined therewith in condition for use.
Figure 2:
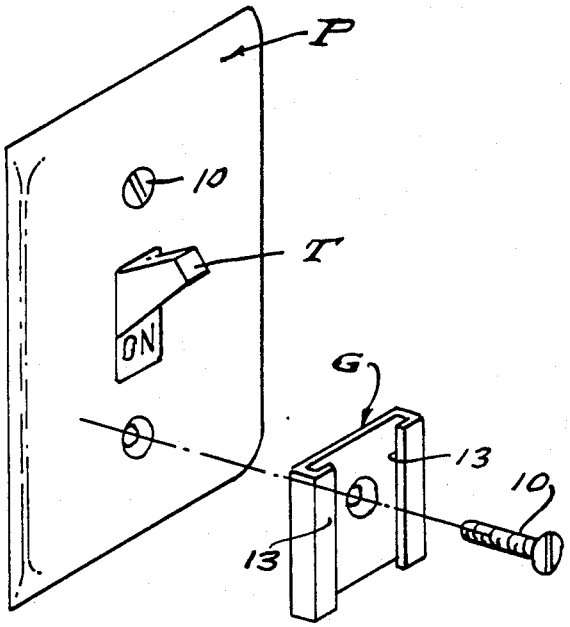
FIG. 2 is an exploded perspective view of the switch plate and Wall Switch Extension Operator shown in FIG. 1, illustrating the manner of assembly without disturbing the switch plate installation with respect to the underlying switch.

The member 14 of operating means O is a relatively thin planar member, having substantial flexibility and resiliency so as to be in a normally flat condition for toggle operation as shown in FIGS. 1, 3 and 4. That is, the member 14 with its aperture 16 embracing the toggle T is relatively stiff and remains straight for pushing and pulling the toggle into its respective "ON" and "OFF" positions. However, flexibility of the member 14 enables its removal from the toggle T and its return into engagement therewith as indicated by arrow a in FIG. 3. Removal of the operating means O is by lifting the top portion of member 14 from the toggle followed by downward withdrawal of the member 14 from the guide means G. Alternately, assembly of the operating means O into working position engaged over the toggle T is simply by insertion of the member 14 upwardly through the guide means G, with the toggle in its upward "ON" position, whereupon flexibility of the member 14 enables it to be automatically lifted and to slide up the obtuse 120° incline of the toggle until the aperture 16 drops over the toggle to embrace the same. The switch S can then be operated by upward and downward movement of the member 14.

In accordance with this invention, the operating means O includes an operating member 17 that depends a substantial distance below the guide means G, so as to be manipulated from a position well below the switch plate P. In practice, this distance is twelve inches or more, and it is the extended lower portion of the member 17 that is to be manipulated, and to this end the member 17 is of heavier cross section than the member 14 so that it remains relatively straight for pushing upwardly as well as pulling downwardly. In order to avoid lateral stress on the member 14 and the guide means G, the member 17 is swively connected to the member 14 by means of a pin 18 or the like, so that it swings freely from side to side for angular convenience as may be required. Flexibility of the member 14 also permits angular separation of the member 17 from the wall. As shown, the lowermost terminal end of the member 17 is turned outwardly to form a finger grip 19 for its manipulation.

From the foregoing it will be understood how the Wall Switch Extension Operator of the present invention is constructed and used, and the nature of its permanency without disturbing the wall switch installation. Also, the features of assembly and disassembly utilizing the flexibility of the operating member 14 for removal and automatic assembly are important utilitarian features, especially with the involvement of children. Thus, the guide means G can be installed to remain intact, while the operating means is readily removable and easily replaceable.

Having described only the typical preferred form and application of my invention, I do not wish to be limited or restricted to the specific details herein set forth, but wish to reserve to myself any modifications or variations that may appear to those skilled in the art as set forth within the limits of the following claims.

I claim:

1. A wall switch extension operator for a wall switch installation permanently covered by a switch plate through which a pivotal toggle projects for manipulation into alternate angular "ON" and "OFF" positions, there being upper and lower fasteners and either of which permanently secures the switch plate to a wall to cover a switch and its electrical wiring, and including;

a guide means attached to an exterior of the switch plate by one of said fasteners removed from the switch plate and replaced through the guide means and the switch plate securing one to another, and operating means comprised of a flexible member of resilient material and slideably engaged through the guide means in alignment with movement of the toggle and with a portion projecting freely from the guide means and having an aperture engaged over the toggle to push and pull the toggle into said alternate angular "ON" and "OFF" positions and removable from the toggle by manually deflecting it therefrom , the operating means being extended from the guide means and switch plate for manipulation remote therefrom.

2. The wall switch extension operator for a wall switch installation as set forth in claim 1, wherein the guide means is comprised of a thin body overlying the switch plate and having parallel side rails, and wherein the flexible member of the operating means has parallel side edges slideably engaged through the parallel side rails of the guide means.

3. The wall switch extension for a wall switch installation as set forth in claim 1, wherein the guide means is comprised of a thin body overlying the switch plate and having parallel side rails, and wherein the flexible member of the operating means has parallel side edges engaged through the parallel side rails of the guide means and deflected by the toggle in its upwardly angular "ON" position to engage over the toggle to alternately position the same by means of push and pull manipulation.

4. The wall switch extension operator for a wall switch installation as set forth in claim 3, wherein the operating means includes an extension member swiveled to the flexible member on an axis positioned away from the guide means body to swing laterally thereof.

* * * * *